United States Patent [19]

Krämer et al.

[11] 4,270,316

[45] Jun. 2, 1981

[54] PROCESS FOR EVENING OUT THE AMOUNT OF MATERIAL REMOVED FROM DISCS IN POLISHING

[75] Inventors: Hans Krämer; Helmuth Kirschner, both of Burghausen, Fed. Rep. of Germany

[73] Assignee: Wacker-Chemitronic Gesellschaft für Elektronik-Grundstoffe mbH, Burghausen, Fed. Rep. of Germany

[21] Appl. No.: 14,458

[22] Filed: Feb. 23, 1979

[30] Foreign Application Priority Data

Mar. 3, 1978 [DE] Fed. Rep. of Germany ..... 2809274

[51] Int. Cl.[3] ..... B24B 7/22

[52] U.S. Cl. ..... 51/283 R; 51/281 SF; 51/131.4; 51/266

[58] Field of Search ..... 51/131.4, 266, 283 R, 51/322, 281 SF

[56] References Cited

U.S. PATENT DOCUMENTS

| | | | |
|---|---|---|---|
| 3,449,870 | 6/1969 | Jensen | 51/131.4 X |
| 3,603,042 | 9/1971 | Boettcher | 51/266 X |
| 3,631,634 | 1/1972 | Weber | 51/131.4 |
| 3,754,359 | 8/1973 | Scandalestos | 51/266 X |
| 4,020,600 | 5/1977 | Day | 51/131.4 X |
| 4,132,037 | 1/1979 | Bonora | 51/131.4 |

FOREIGN PATENT DOCUMENTS 1014873 2/1958 Fed. Rep. of Germany .

*Primary Examiner*—Gary L. Smith

*Attorney, Agent, or Firm*—Allison C. Collard; Thomas M. Galgano

[57] ABSTRACT

In conventional polishing machines, uneven transmission of pressure causes different degrees of abrasion of the polished discs which results in different thicknesses over one disc and also with respect to other discs in one polishing batch. This problem is solved according to the invention by the provision of soft elastic inserts between the pressure piston and the back of the carrier plate on which the discs to be polished are cemented.

4 Claims, 6 Drawing Figures

PROCESS FOR EVENING OUT THE AMOUNT OF MATERIAL REMOVED FROM DISCS IN POLISHING

The invention relates to a process for evening out the amount of material removed from discs in polishing. More particularly, it relates to such a process used in association with polishing machines equipped with a polishing plate covered with a polishing cloth, one or more carrier plates each having a side which faces the polishing plate on which the discs to be polished are cemented, and also pressure pistons which press the carrier plates against the polishing plate covered with a polishing cloth.

In planar technique, the series of layers with different types of conductivity which are necessary for the functioning of the individual components is produced by a series of discrete processes starting from the planar surfaces of monocrystalline semiconductor discs. Especially when using photolithographic processes, wavy, curved or wedge-shaped semiconductor discs result in lack of definition when the photosensitive resist applied to the surface of the discs is exposed. It is therefore not possible to produce from such discs, components having a high circuit-packing density. Since, however, there is a predominant tendency in the semiconductor industry towards higher and higher circuit-packing densities, the tolerances as regards the thickness, wedge-shape property or planeness of the semiconductor discs used in these processes, which are only just acceptable to the manufacturers of the components, are becoming smaller and smaller.

Various processing steps are responsible for the geometrical deviations of the individual semiconductor discs or platelets from the desired norm: apart from machining or chemical treatment, more particularly, sawing, lapping or etching of the discs, there is also the actual polishing and the determining parameters connected with this process step. While processes for optimizing the cementing of the discs to the carrier plates of the polishing machine, for example, those described in German Offenlegungsschriften Nos. 26 08 427 and 27 12 521, have led to a reduction in the geometrical deviations of the individual semiconductor discs, the results that can be achieved by these processes are still not entirely satisfactory in view of the ever higher quality demanded of the discs.

It has been found that, in the case of the annular cementing pattern of the discs to be polished, considerable differences sometimes occur between the individual cementing rings in the average amount of material removed. For example, the amount removed in the middle cementing ring is clearly dependent on the polishing run and thus on the service life of the polishing cloth. The nature of this dependence is such that when the service life is short, more material is removed than in the outer ring and when the service life is long, less material is removed than in the outer ring. The same applies to the inner cementing ring, the relationship between the amount of material removed and the service life being even more pronounced in this case. As a result of this phenomenon, the polished discs become wedge-shaped in a radial direction. If, for example, the discs are cemented on with their "flat"—a term used herein to mean a mark at the circumference of the discs to identify the crystallographic orientation of the respective disc—towards the center of the carrier plate, wedging occurs perpendicular to the flat, the flat lying at the pointed end of the wedge during the initial polishing runs until roughly the tenth polishing run, while after roughly about the thirtieth polishing run the flat lies at the thick end of the wedge. Owing to this difference in the thickness value between the outer ring and the middle ring, which depends on the run, during roughly the first ten polishing runs and also during the last polishing runs in excess of thirty, the thickness tolerance of the polished discs is relatively poor. The measured wedge-formation is generally greater, the greater is the difference between the average thickness value in the outer ring and the average thickness value in the middle ring. The thickness value is in each case determined in the center of the individual discs.

Furthermore, it can be established that within one cementing ring, sometimes very varied amounts of material are removed towards the circumference, which results in correspondingly varying thicknesses of the individual discs. This phenomenon may be attributed to a varying bearing pressure during polishing, caused by a slight unevenness of the back of the carrier plate. If, for example, the back of a carrier plate is measured in the region of the outer cementing ring towards its circumference, assuming that the front has been lapped completely even, two fundamental defects are usually apparent: 1. a saddle shape having two maxima and two minima, maximum and minimum each being displaced by 90°, and 2. a wedge-shape having one maximum and one minimum displaced by approximately 180°. Especially in the case of a saddle-shaped unevenness, marked differences occur in the amount of material removed during polishing; at the points where the plate is thickest (maxima) maximum amounts of material are removed and thus the discs are of minimum thickness, while at the points where the plate is thinnest (minima) minimum amounts of material are removed and thus the discs are of maximum thickness. The further the discs are cemented from the center of the carrier plate, the more seriously pronounced this effect becomes. Consequently, there are sharply differing thickness values towards the circumference, resulting from differing amounts of material being removed, and a wedge-formation which is parallel to the flat.

The underlying problem of the invention was, therefore, to achieve in the polishing process by suitable measures a uniform distribution of pressure and thus abrasion forces that act uniformly on all the discs, in order to be able to ensure that the semiconductor discs have low tolerances as regards their thickness, wedge-shape property and waviness.

This problem is solved by placing inserts consisting of soft elastic bodies between the pressure piston and the back of the carrier plate.

The term "elastic bodies" is used herein to mean generally extensible and compressible resilient materials which have the tendency to nullify the deformations occuring under the action of deforming forces. Especially suitable for this purpose are soft elastic bodies having pressure-equalization cells, for example, graphite foams or silicone foams, plastics foams, such as, for example, polyethylene foams, it being possible to fill the pressure-equalization cells with either gas or liquid. Air-cushion films are preferably used, such as, more particularly, polyethylene films of various gauges, having air cells of various diameters.

By inserting such soft elastic bodies between the pressure pistons and the backs of the carrier plates, any unevenness on both parts is evened out.

Other objects and features of the present invention will become apparent from the following detailed description when taken in connection with the accompanying drawings which disclose several embodiments of the invention. It is to be understood that the drawings are designed for the purpose of illustration only, and are not intended as a definition of the limits and scope of the invention.

In the drawings, wherein similar reference characters denote similar elements throughout the several views.

Figure 1:
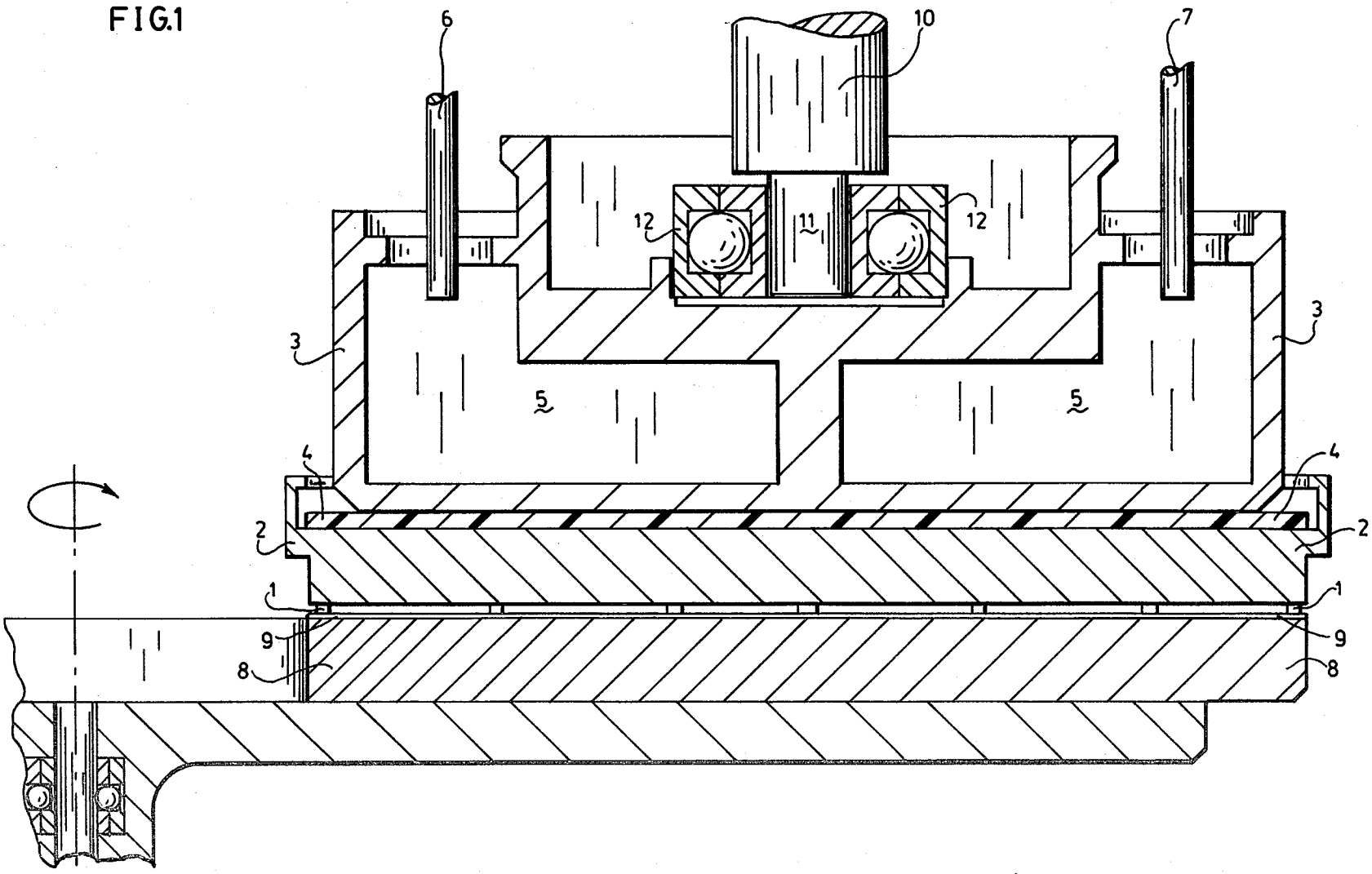
FIG. 1 is a schematically and fragmentarily-illustrated sectional view of a conventional polishing machine used in association with the invention.

Referring now in detail to the drawings, when polishing, for example, semiconductor discs 1, they are generally cemented in concentric rings onto the planar face of a carrier plate 2 usually made of stainless steel or aluminium. Before the pressure piston 3 is applied to the back of the carrier plate, a soft elastic insert 4 is introduced. The pressure piston 3 of customary or conventional polishing machines is provided with a cooling system which carries away the heat caused by friction during the polishing operation. In the most simple case, this cooling system consists of a hollow space 5 through which a coolant, in the most simple case water, is passed by means of the supply pipes 6 and 7. The pressure with which the discs 1 to be polished are pressed against the polishing cloth 9 covering the polishing plate 8 is produced by the pressure cylinder 11 attached to the cylinder rod 10. During polishing, the polishing plate 8 is caused to rotate by suitable drive means. As a result, the system comprising carrier plate 2 and pressure piston 3 with cooling system 5 (cooling vessel), which system is connected to the rigidly mounted pressure cylinder 11 by a friction bearing 12, is caused to rotate in the same direction.

Figure 2:
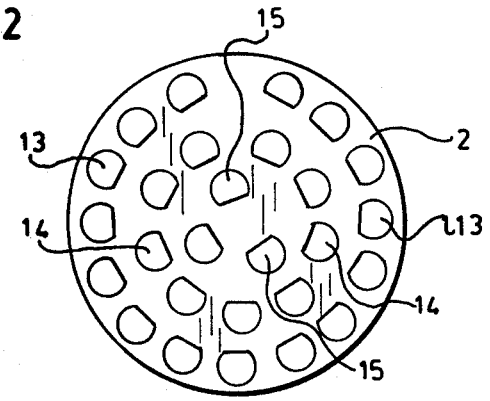
FIG. 2 is a plan view of the face of a carrier plate having discs to be polished cemented thereto; and FIGS. *3a–3d* show four elastic inserts of different shapes.

An improvement as regards a uniform amount of material removed in polishing is achieved with soft elastic inserts 4 of any desired shape. It is necessary only to ensure as best as possible that any direct contact between the metal faces of the pressure piston 3 and the back of the carrier plate 2 is avoided. The thickness deviation and the wedge-shape property of the polished silicon discs may be further improved to a considerable extent, however, by selecting inserts of particular shapes. In order to do this, it is necessary to determine the average thickness value of the discs in the individual cementing rings after each polishing run. FIG. 2 shows, by way of example, a carrier plate 2 on which silicon discs are cemented in three cementing rings, an outer cementing ring 13, a middle cementing ring 14, and an inner cementing ring 15. The number of cementing rings depends in general on the size of the carrier plates used and on the diameters of the discs to be polished.

If, after one polishing run, it is ascertained that the average thickness value of the polished discs in the outer cementing ring 13 is greater than the average thickness value in the middle cementing ring 14, then it is advisable to introduce annular inserts *4a* or *4b*, such as those shown in FIG. *3a* or FIG. *3b*, respectively, since by means of this shape of insert the pressure is transmitted to the outer zones of the plate thus effecting an increase in the amount of material removed in the outer region of the plate and a decrease in the amount of material removed in the inner region of the plate. As a result, there is a smaller difference between the thickness values of the outer and middle cementing rings and thus the thickness deviation and the wedge-shape property perpendicular to the flat is reduced. The selection of an annular insert according to FIG. *3a* or FIG. *3b* depends on the required increase in the amount of material removed in the outer ring because the amount of material removed in the outer region of the plate is increased, the further out the transmission of pressure takes place, that is to say, the narrower the width of the ring.

If the average thickness value in the outer cementing ring 13 roughly corresponds to the average thickness value in the middle cementing ring 14, then the pressure must be transmitted over the whole of the surface since, in this case, the best condition has been achieved and thickness tolerance and wedge-shape property have attained good values. In this case, inserts such as inserts *4c* shown in FIG. *3c* are advisable, the diameters of which substantially correspond to the diameter of the back of the carrier plate. In cases where the average thickness value in the outer cementing ring 13 is less than the average thickness value in the middle cementing ring 14, circular inserts having a diameter which is substantially smaller than the diameter of the carrier plate have to be introduced, that is, for example, inserts *4d* such as that shown in FIG. *3d*. These inserts transmit the polishing pressure to the center of the plate. This results in an increase in the amount of material removed in the inner region of the plate. Consequently, smaller differences are produced in the thickness values in the outer and middle cementing rings which leads to an improvement in the thickness deviation and especially the wedge-shape property perpendicular to the flat. When the amount of material removed in the inner region of the plate is increased, the diameter of these central inserts becomes smaller.

It may generally be said that in order to reduce the difference in the amounts of material removed from cementing ring to cementing ring, various shapes of inserts may be used, the choice of which depends on the thickness values measured in the previous polishing run. For the first polishing run, an insert is selected which is more or less specific to a machine and must be determined experimentally for each individual polishing machine. All polishing plates are shaped of deformed differently, according to their manufacture. In addition to this, the material to be polished must also be taken into account. If, for example, silicon discs are polished, 100-oriented silicon discs do not necessarily behave in the same way as 111-oriented silicon discs. Similarly, differing behavior is observed if, for example, four cementing rings of 2-inch discs, three cementing rings of 3-inch discs or, for example, two cementing rings of 4-inch discs are cemented to the carrier plate. It is also necessary to take into account the fact that when such disc specifications are changed, uneven wear of the polishing cloths also occurs which, however, may similarly be compensated to a large extent by selecting the correct insert. In general, it has proved advantageous to compare the measured values of the outermost and the adjacent or "next inner" cementing ring when polishing 3-inch or 4-inch discs, while in the case of smaller discs having a diameter of, for example, 2 inches, a comparison between the measured values for the outer and the "next-but-one" inner cementing ring (i.e., the ring inwardly adjacent to the "next inner" ring) is advantageous and produces good results.

Figure 3A:
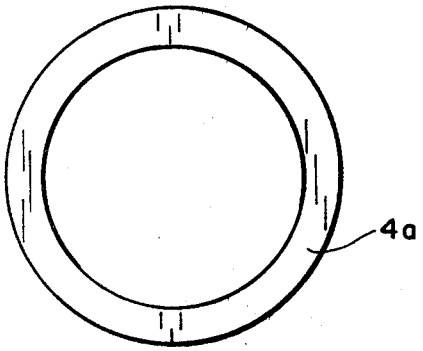
Figure 3B:
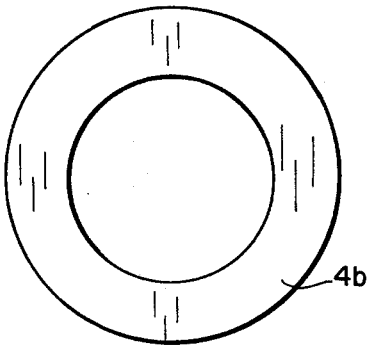
Figure 3C:
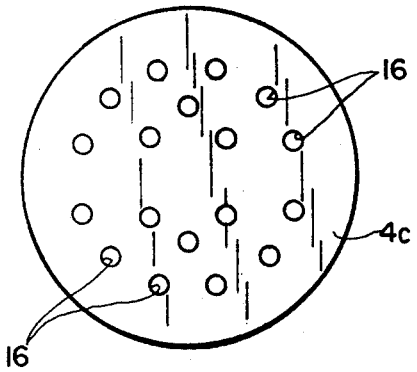
Figure 3D:
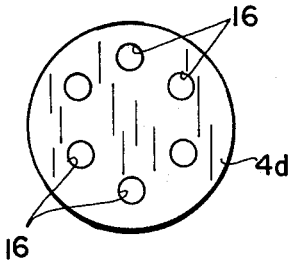

When polishing with elastic inserts, the heat insulation thereof has an adverse effect, so that the action of the cooling vessels, that is to say, of the cooled pressure pistons, is practically eliminated. In order to increase the cooling provided by the vessel to the extent that sufficient cooling action is achieved even during polishing runs on new polishing cloths, in which, according to natural laws, there is a correspondingly high friction and a correspondingly high degree of heat evolution, it is advisable to fill the back of the carrier plates with a coolant, for example, water, as a heat transfer medium. Continuous inserts such as that shown in FIG. 3*c* are advantageously constructed with large free spaces 16 in order to improve the heat transfer by the water between the back of the carrier plates and the pressure piston or cooling vessel.

By using the soft elastic inserts according to the invention, the effects of the back of the carrier plate and the pressure piston or the underside of the cooling vessel can to a large extent by eliminated. At the same time, by selecting inserts of advantageous shape, the action of the polishing cloth can also be reduced, as a result of which a considerable improvement as regards the thickness deviation and the wedge-shape property of the polished discs on one polishing carrier plate is achieved.

EXAMPLE 87 polishing runs were carried out without inserting soft elastic bodies between the pressure pistons and the backs of the carrier plates and 87 polishing runs were carried out with the insertion of various soft elastic bodies, under otherwise identical conditions, especially with regard to the polishing agent used, the polishing cloths used, the bearing pressure and the rotation of the polishing plate. The term "polishing run" is used herein to mean the polishing of all the discs polished simultaneously in a polishing machine, and in the case of the machines used, in each case 96 3-inch discs (diameter 76.2mm). After the polishing machines had each been fitted with four carrier plates, 24 silicon discs were cemented onto each carrier plate in two concentric rings, with a maleic resin α-naphthol mixture. In the 87 polishing runs with inserts, the following elastic inserts were used:

1. Air cushion films:

Types produced by Alkor-Oerlikon (now AOE-Plastic GmbH, Postfach 900 225, D 8000 München 90, West Germany) (polyethylene films):

LP N (two-layer, air cells ϕ 6 mm, film gauge 200 μm)
LP M (two-layer, air cells ϕ 10 mm, film gauge 200 μm)
LP S (two-layer, air cells ϕ 30 mm, film gauge 200 μm)
LP M (two-layer, air cells ϕ 10 mm, film gauge 200 μm) with aluminium-lined reverse side)
LP M-3(three layer, air cells ϕ 10 mm, film gauge 180 μm)
LP M-3 (three-layer, air cells ϕ 10 mm, film gauge 600 μm)

Type produced by Sealed Air: (Am Brückenweg 36, D-6090 Rüsselsheim, West Germany)

Aircap Ci 480 (internally lined polyethylene film, air cells ϕ 10 mm, film gauge 300 μm)

2. Foam materials:

3 and 4 mm thick silicone foams
Polyetheylene foam type 81002 produced by Alkor

3. Air cushions:

self-welded air cushions made of polyethylene and polyethylene/polyamide films
self-bonded air cushions made of rubber In every case, the backs of the carrier plates were filled with water, as the heat transfer medium, in order to achieve better heat removal. From their effect as regards narrower thickness tolerances and smaller wedge-shape values, all the inserts tested were suitable. After comparing the service life and the cost price, the three-layer polyethylene air cushion films were found to be the most favorable insert, especially the three-layer polyethylene air cushion film having air cells of 10 mm ϕ and a film gauge of 600 μm, with which two thirds of the polishing runs using inserts were finally carried out. The results obtained are compared in the table below. The values given were obtained by evaluating, in each case, 87 five-point measuring recordings, (1 measuring recording corresponds to one polishing run) of 3-inch silicon discs. In each of these five-point measuring recordings, the data of the 96 silicon discs polished simultaneously in each case were determined. For this purpose, each small disc was measured at five points, namely in the middle and at four points on the circumference of the disc, beginning in the middle of the flat, these four points being separated from each other by 90°.

TABLE

Comparison of the average measured values when using the polishing runs with and without air cushion inserts.

| Measured variables (Average value per polishing batch) $10^{-6}$m | Polishing without air-cushion inserts | Polishing with air-cushion inserts |
|---|---|---|
| Standard deviation of the thickness distribution, measured at the center of the disc | 6.33 | 3.47 |
| Variation of standard deviation | 1.43 | 1.11 |
| Maximum difference in the thickness value at the center of the disc | 31.7 | 15.4 |
| Variation of maximum difference in the thickness value | 8.9 | 4.8 |
| Maximum difference in the thickness value over 5 measuring points | 47.5 | 20.8 |
| Variation in thickness per disc over 5 measuring points | 5.69 | 4.36 |
| Wedge-shape property K 1.3 (perpendicular to the flat) | 4.67 | 3.59 |
| Wedge-shape property K 2.4 (parallel to the flat) | 3.48 | 1.76 |

Thus, while only several embodiments of the present invention have been shown and described, it will be obvious to those persons of ordinary skill in the art, that many changes and modifications may be made thereunto without departing from the spirit and scope of the invention.

What is claimed is:

1. In a process for evening out the amount of material removed from discs in a polishing operation performed with a polishing machine equipped with a polishing plate covered with a polishing cloth, at least one carrier plate having a side which faces the polishing plate on which the discs to be polished are cemented and at least one pressure piston which presses the carrier plate against the polishing plate covered by the polishing cloth, the improvement comprising:

placing inserts comprising soft elastic bodies having pressure-equalization cells between said pressure piston and the back of the carrier plate.

2. The process according to claim 1 wherein said soft elastic bodies comprise air-cushion films.

3. The process according to claim 1 additionally including the step of introducing a heat transfer medium between the pressure piston and the back of the carrier plate in order to offset the heat-insulating effect of the inserts.

4. The process according to claim 2, wherein said air-cushion films comprise polyethylene films having air cells.

* * * * *